US010115348B2

(12) United States Patent
Ma

(10) Patent No.: US 10,115,348 B2
(45) Date of Patent: Oct. 30, 2018

(54) PIXEL CIRCUIT, DRIVING METHOD THEREOF AND ORGANIC ELECTROLUMINESCENT DISPLAY PANEL

(71) Applicant: BOE TECHNOLOGY GROUP CO., LTD., Beijing (CN)

(72) Inventor: Zhanjie Ma, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/221,250

(22) Filed: Jul. 27, 2016

(65) Prior Publication Data

US 2017/0270869 A1 Sep. 21, 2017

(30) Foreign Application Priority Data

Mar. 21, 2016 (CN) ..... 2016 1 0162659

(51) Int. Cl.

| | |
|---|---|
| ***G09G 3/30*** | (2006.01) |
| ***G09G 3/3275*** | (2016.01) |
| ***G09G 3/3266*** | (2016.01) |
| ***G09G 3/3233*** | (2016.01) |

(52) U.S. Cl.

CPC ..... *G09G 3/3275* (2013.01); *G09G 3/3233* (2013.01); *G09G 3/3266* (2013.01); *G09G 2300/0819* (2013.01); *G09G 2300/0842* (2013.01); *G09G 2300/0861* (2013.01); *G09G 2320/0233* (2013.01); *G09G 2320/045* (2013.01)

(58) Field of Classification Search

CPC ..... G09G 3/12; G09G 3/30–3/3291

See application file for complete search history.

(56) References Cited

U.S. PATENT DOCUMENTS

| | | | |
|---|---|---|---|
| 2006/0055336 | A1 | 3/2006 | Jeong |
| 2007/0063932 | A1 | 3/2007 | Nathan et al. |
| 2010/0039458 | A1 | 2/2010 | Nathan et al. |

(Continued)

FOREIGN PATENT DOCUMENTS

| | | | |
|---|---|---|---|
| CN | 102057418 | A | 5/2011 |
| CN | 102708791 | A | 10/2012 |
| CN | 103000131 | A | 3/2013 |

OTHER PUBLICATIONS

Office Action in Chinese Application No. 201610162659.6 dated Aug. 9, 2017, with English translation.

*Primary Examiner* — Sanghyuk Park

(74) *Attorney, Agent, or Firm* — Womble Bond Dickinson (US) LLP

(57) ABSTRACT

A pixel circuit, a driving method thereof and an organic electroluminescent display panel are disclosed. The pixel circuit comprises a driving transistor, a data write module, a compensation control module, a storage module and a light emitting control module. By means of cooperation of the above four modules, the working current of the driving transistor that drives the light emitting device to emit light can be unrelated to the threshold voltage of the driving transistor, which can avoid drift of the threshold voltage from influencing the light emitting device, thereby enabling the working current that drives the light emitting device to emit light to remain stable, so as to improve brightness uniformity of the displayed image.

16 Claims, 8 Drawing Sheets

(56) References Cited

U.S. PATENT DOCUMENTS

| | | | | |
|---|---|---|---|---|
| 2011/0109299 | A1* | 5/2011 | Chaji | G09G 3/3283 324/76.11 |
| 2011/0157135 | A1* | 6/2011 | Lee | G09G 3/3291 345/211 |
| 2012/0162175 | A1* | 6/2012 | Fan | G09G 3/3258 345/211 |
| 2014/0191669 | A1 | 7/2014 | Tan et al. | |
| 2015/0379956 | A1* | 12/2015 | Nonaka | G09G 3/3233 315/172 |
| 2016/0093247 | A1* | 3/2016 | Lim | G09G 3/2003 345/694 |

* cited by examiner

PIXEL CIRCUIT, DRIVING METHOD THEREOF AND ORGANIC ELECTROLUMINESCENT DISPLAY PANEL

RELATED APPLICATION

The present application claims the benefit of Chinese Patent Application No. 201610162659.6, filed on Mar. 21, 2016, the entire disclosure of which is incorporated herein by reference.

FIELD OF THE INVENTION

This disclosure relates to the field of display technology, particularly to a pixel circuit, a driving method thereof and an organic electroluminescent display panel.

BACKGROUND

The organic light emitting diode (OLED) display is one of the hotspots in the research field of flat panel display nowadays. Compared with the liquid crystal display (LCD), the OLED display has the advantages of fast response, high brightness, high contrast, low power consumption and easy to achieve flexible display etc., and is regarded as the mainstream display of the next generation. The pixel circuit is the core technical content of the OLED display, which has important research significance. Different from the LCD that uses a stable voltage to control the brightness, the OLED display is of current driven type, which requires a stable current to control the brightness. However, due to factors such as manufacture process and aging of the light emitting device, there may be nonuniformity in the threshold voltages $V_{th}$ of the driving transistors in the pixel circuit, which may result in variation to the current flowing through each OLED such that the displaying brightness is nonuniform, thereby influencing the display effect of the whole image.

SUMMARY

Embodiments of the invention provide a pixel circuit, a driving method thereof and an organic electroluminescent display panel, for mitigating or avoiding drift of the threshold voltage of the driving transistor from influencing the light emitting device, so as to enable the working current that drives the light emitting device to emit light to remain stable and improve brightness uniformity of the displayed image.

An embodiment of the invention provides a pixel circuit, which comprises a driving transistor, a data write module, a first terminal of the data write module being connected with a scanning signal, a second terminal of the data write module being connected with a data signal, a third terminal of the data write module being connected with a source of the driving transistor, the data write module being used for providing the data signal to the source of the driving transistor under the control of the scanning signal, a compensation control module, a first terminal of the compensation control module being connected with the scanning signal, a second terminal of the compensation control module being used for receiving a preset bias current, a third terminal of the compensation control module being connected with a gate of the driving transistor, a fourth terminal of the compensation control module being connected with a drain of the driving transistor, the compensation control module being used to provide the preset bias current to the drain of the driving transistor under the control of the scanning signal, and control the driving transistor to be in a saturation state so as to enable a current flowing through the driving transistor to be the preset bias current, a storage module, a first terminal of the storage module being connected with a first reference signal, a second terminal of the storage module being connected with the gate of the driving transistor, the storage module being used for receiving the first reference signal and a gate voltage of the driving transistor so as to be charged, and a light emitting control module, a first terminal of the light emitting control module being connected with a light emitting control signal, a second terminal of the light emitting control module being connected with the first reference signal, a third terminal of the light emitting control module being connected with the source of the driving transistor, a fourth terminal of the light emitting control module being connected with the drain of the driving transistor, a fifth terminal of the light emitting control module being connected with a first terminal of a light emitting device, a second terminal of the light emitting device being connected with a second reference signal, the light emitting control module being used for communicating the first reference signal with the driving transistor, and communicating the driving transistor with the light emitting device under the control of the light emitting control signal, so as to control the driving transistor to drive the light emitting device to emit light. A voltage of the first reference signal is greater than a voltage of the second reference signal.

In some embodiments, the data write module comprises a first switch transistor. A gate of the first switch transistor is connected with the scanning signal, a source of the first switch transistor is connected with the data signal, and a drain of the first switch transistor is connected with the source of the driving transistor.

In some embodiments, the compensation control module comprises a second switch transistor and a third switch transistor. A gate of the second switch transistor is connected with the scanning signal, a source of the second switch transistor is used for receiving the preset bias current, a drain of the second switch transistor is connected with the drain of the driving transistor and a source of the third switch transistor respectively. A gate of the third switch transistor is connected with the scanning signal, a drain of the third switch transistor is connected with the gate of the driving transistor.

In some embodiments, the storage module comprises a capacitor, a first terminal of the capacitor is connected with the first reference signal, a second terminal of the capacitor is connected with the gate of the driving transistor.

In some embodiments, the driving transistor comprises a P-type transistor.

In some embodiment, the light emitting control module comprises a fourth switch transistor and a fifth switch transistor. A gate of the fourth switch transistor is connected with the light emitting control signal, a source of the fourth switch transistor is connected with the first reference signal, a drain of the fourth switch transistor is connected with the source of the driving transistor. A gate of the fifth switch transistor is connected with the light emitting control signal, a source of the fifth switch transistor is connected with the drain of the driving transistor, a drain of the fifth switch transistor is connected with the first terminal of the light emitting device.

In some embodiments, all the switch transistors are P-type switch transistors.

In some embodiments, the driving transistor comprises an N-type transistor.

In some embodiments, the light emitting control module comprises a fourth switch transistor and a fifth switch transistor. A gate of the fourth switch transistor is connected with the light emitting control signal, a source of the fourth switch transistor is connected with the first reference signal, a drain of the fourth switch transistor is connected with the drain of the driving transistor. A gate of the fifth switch transistor is connected with the light emitting control signal, a source of the fifth switch transistor is connected with the source of the driving transistor, a drain of the fifth switch transistor is connected with the first terminal of the light emitting device.

In some embodiments, all the switch transistors are N-type switch transistors.

Another embodiment of the invention further provides an organic electroluminescent display panel, comprising a pixel circuit provided by any of the above embodiments of the invention.

A further embodiment of the invention provides a method for driving a pixel circuit. The pixel circuit may be a pixel circuit provided by any of the above embodiments of the invention. The method comprises a compensation phase and a light emitting phase. In the compensation phase, the data write module provides the data signal to the source of the driving transistor under the control of the scanning signal, the compensation control module provides the preset bias current to the drain of the driving transistor under the control of the scanning signal and controls the driving transistor to be in a saturation state, so as to enable a current flowing through the driving transistor to be the preset bias current. The storage module receives the first reference signal and a gate voltage of the driving transistor so as to be charged. In the light emitting phase, the light emitting control module communicates the first reference signal with the driving transistor and communicates the driving transistor with the light emitting device under the control of the light emitting control signal, so as to control the driving transistor to drive the light emitting device to emit light.

Embodiments of the invention provide a pixel circuit, a driving method thereof and an organic electroluminescent display panel. The pixel circuit comprises a driving transistor, a data write module, a compensation control module, a storage module and a light emitting control module. The data write module is used for providing the data signal to the source of the driving transistor under the control of the scanning signal. The compensation control module is used to provide the preset bias current to the drain of the driving transistor under the control of the scanning signal and control the driving transistor to be in a saturation state, so as to enable a current flowing through the driving transistor to be the preset bias current. The storage module is used for receiving the first reference signal and a gate voltage of the driving transistor so as to be charged. The light emitting control module is used for communicating the first reference signal with the driving transistor and communicating the driving transistor with the light emitting device under the control of the light emitting control signal, so as to control the driving transistor to drive the light emitting device to emit light. A voltage of the first reference signal is greater than a voltage of the second reference signal. For the pixel circuits provided by the embodiments of the invention, by means of cooperation of the above four modules, the working current of the driving transistor that drives the light emitting device to emit light can be unrelated to the threshold voltage of the driving transistor, which can avoid drift of the threshold voltage from influencing the light emitting device, thereby enabling the working current that drives the light emitting device to emit light to remain stable, so as to improve brightness uniformity of the displayed image.

DETAILED DESCRIPTION

Next, the specific implementations of the pixel circuit, the driving method thereof and the organic electroluminescent display panel provided by embodiments of the present invention will be explained in detail with reference to the drawings.

Figure 1A:
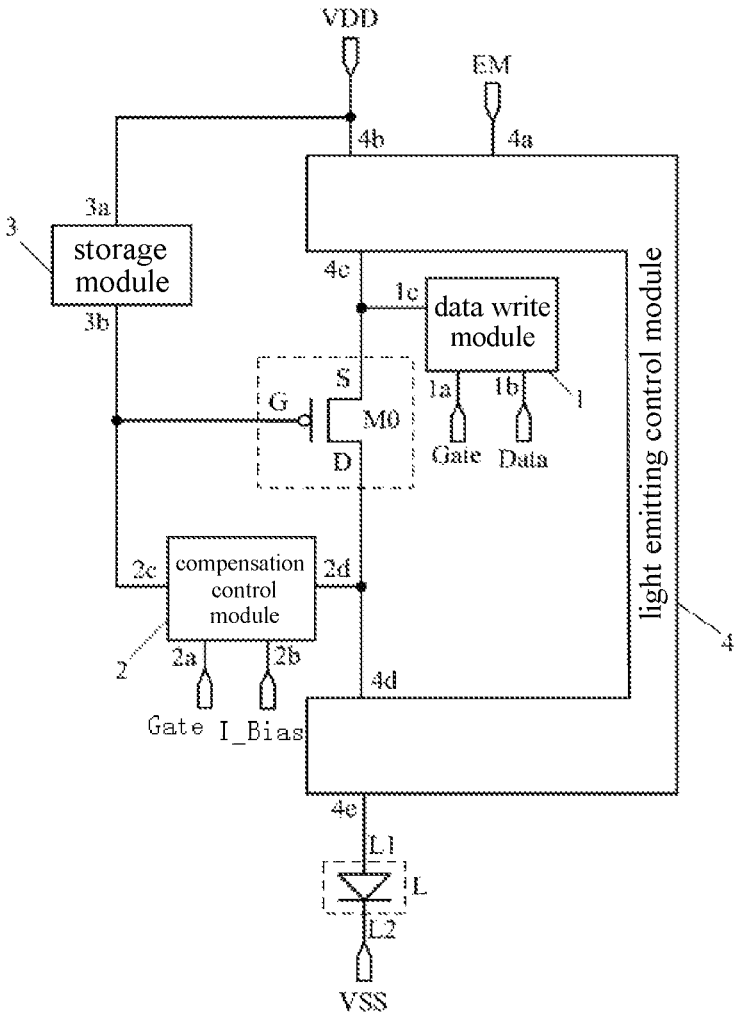
FIG. 1*a* is a structural schematic view of a pixel circuit provided by an embodiment of the present invention.
Figure 1B:
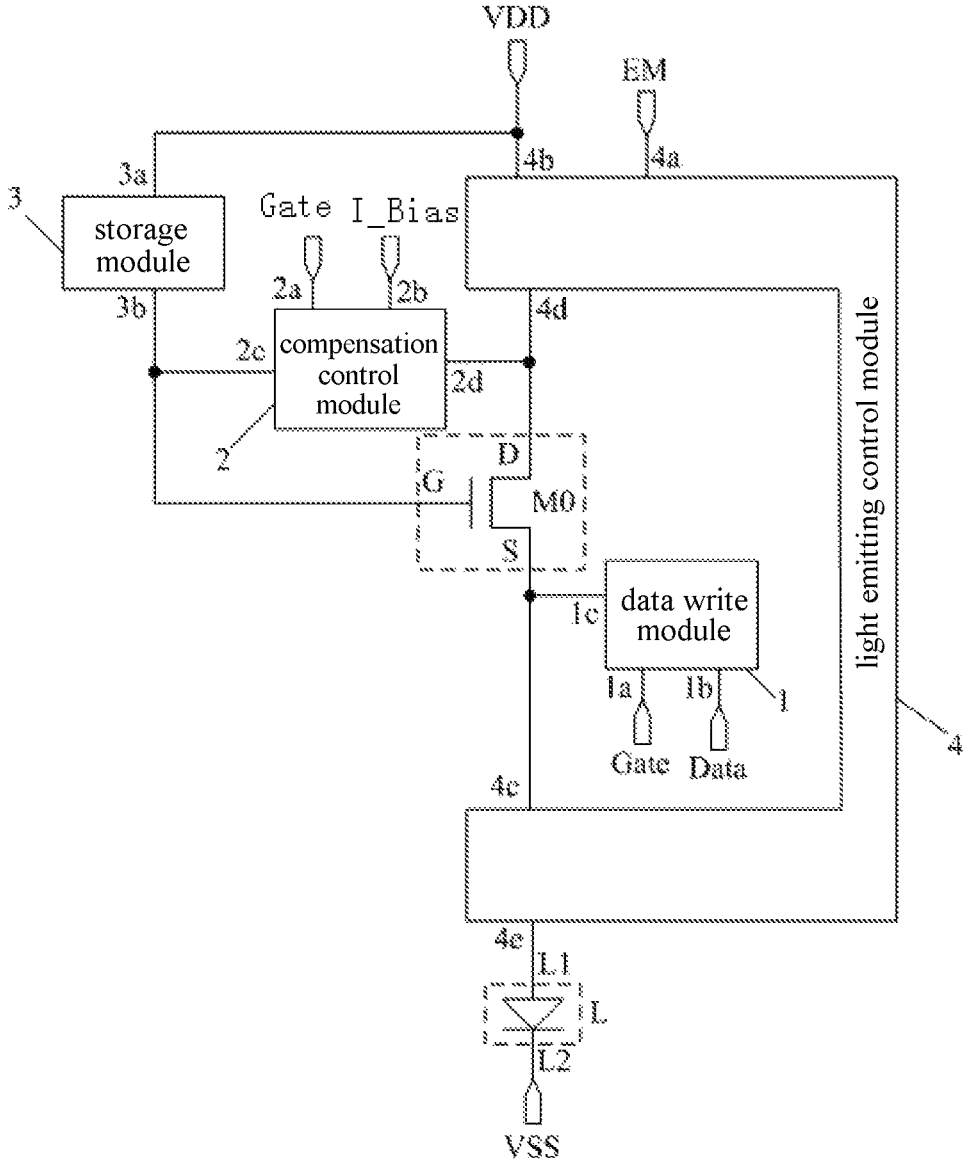
FIG. 1*b* is a structure schematic view of a pixel circuit provided by another embodiment of the present invention.

As shown in FIG. 1*a* and FIG. 1*b*, a pixel circuit provided by embodiments of the present invention comprises a driving transistor M0, a data write module 1, a compensation control module 2, a storage module 3 and a light emitting control module 4. A first terminal 1*a* of the data write module 1 is connected with a scanning signal Gate, a second terminal 1*b* is connected with a data signal Data, and a third terminal 1*c* is connected with a source S of the driving transistor M0. The data write module 1 is used for providing the data signal Data to the source S of the driving transistor M0 under the control of the scanning signal Gate. A first terminal 2*a* of the compensation control module 2 is connected with the scanning signal Gate, a second terminal 2*b* is used for receiving a preset bias current I_Bias, a third terminal 2*c* is connected with a gate G of the driving transistor M0, and a fourth terminal 2*d* is connected with a drain D of the driving transistor M0. The compensation control module 2 is used to provide the preset bias current I_Bias to the drain D of the driving transistor M0 under the control of the scanning signal Gate and control the driving transistor M0 to be in a saturation state, so as to enable the current flowing through the driving transistor M0 to be the preset bias current I_Bias. A first terminal 3*a* of the storage module 3 is used for receiving a first reference signal VDD, and a second terminal 3*b* is connected with the gate G of the driving transistor M0. The storage module 3 is used for receiving the first reference signal VDD and the gate voltage of the driving transistor M0 so as to be charged. A first terminal 4*a* of the light emitting control module 4 is used for receiving a light emitting control signal EM, a second terminal 4*b* is connected with the first reference signal VDD, a third terminal 4*c* is connected with the source S of the driving transistor M0, a fourth terminal 4*d* is connected with the drain D of the driving transistor M0, and a fifth terminal 4*e* is connected with a first terminal L1 of a light emitting device L. A second terminal L2 of the light emitting device L is connected with a second reference signal VSS. The light emitting control module 4 is used for communicating the first reference signal VDD with the driving transistor M0 and communicating the driving transistor M0 with the light emitting device L under the control of the light emitting control signal EM, so as to control the driving transistor M0 to drive the light emitting device L to emit light. A voltage of the first reference signal VDD is greater than a voltage of the second reference signal VSS.

The above pixel circuit provided by embodiments of the invention comprises a driving transistor, a data write module, a compensation control module, a storage module and a light emitting control module. The data write module may provide the data signal to the source of the driving transistor under the control of the scanning signal. The compensation control module may provide the preset bias current to the drain of the driving transistor under the control of the scanning signal and control the driving transistor to be in a saturation state, so as to enable the current flowing through the driving transistor to be the preset bias current. The storage module may be charged under the control of the first reference signal and the gate voltage of the driving transistor. The light emitting control module may communicate the first reference signal with the driving transistor and communicate the driving transistor and the light emitting device under the control of the light emitting control signal, so as to control the driving transistor to drive the light emitting device to emit light. The voltage of the first reference signal is greater than the voltage of the second reference signal. For the pixel circuit provided by the embodiments of the invention, by means of the cooperation of the above four modules, the working current of the driving transistor that drives the light emitting device to emit light may be unrelated to the threshold voltage of the driving transistor, which may avoid drift of the threshold voltage from influencing the light emitting device, thereby enabling the working current that drives the light emitting device to emit light to remain stable, so as to improve uniformity in brightness of the displayed image.

For the above pixel circuit provided by the embodiment of the invention, the light emitting device may be an organic electroluminescent diode, which may emit light under the effect of the current of the driving transistor in the saturation state.

In the pixel circuits provided by some embodiments of the invention, as shown in FIG. 1*a*, the driving transistor M0 that drives the light emitting device L to emit light may be a P-type transistor, in this case, the working current of the driving transistor M0 that drives the light emitting device L to emit light flows from the source S of the driving transistor M0 to the drain D of the driving transistor M0. Alternatively, as shown in FIG. 1*b*, the driving transistor M0 that drives the light emitting device L to emit light may also be an N-type transistor, in this case, the working current of the driving transistor M0 that drives the light emitting device L to emit light flows from the drain D of the driving transistor M0 to the source S of the driving transistor M0. For different types of the driving transistors, the flowing directions of the working current that drives the light emitting devices to emit light are different. Hence, the specific connections of the source and the drain of the driving transistor with other modules in the pixel circuit may be also different. The type of the driving transistor and the specific connection of the driving transistor with other modules in the pixel circuit can be determined based on actual conditions, so as to control the driving transistor to drive the light emitting device to emit light, which will not be defined herein.

Next, the pixel circuit provided by the embodiment of the invention will be explained in detail with reference to specific examples. It should be noted that these examples are for explaining the invention better but not for limiting the invention.

Figure 2A:
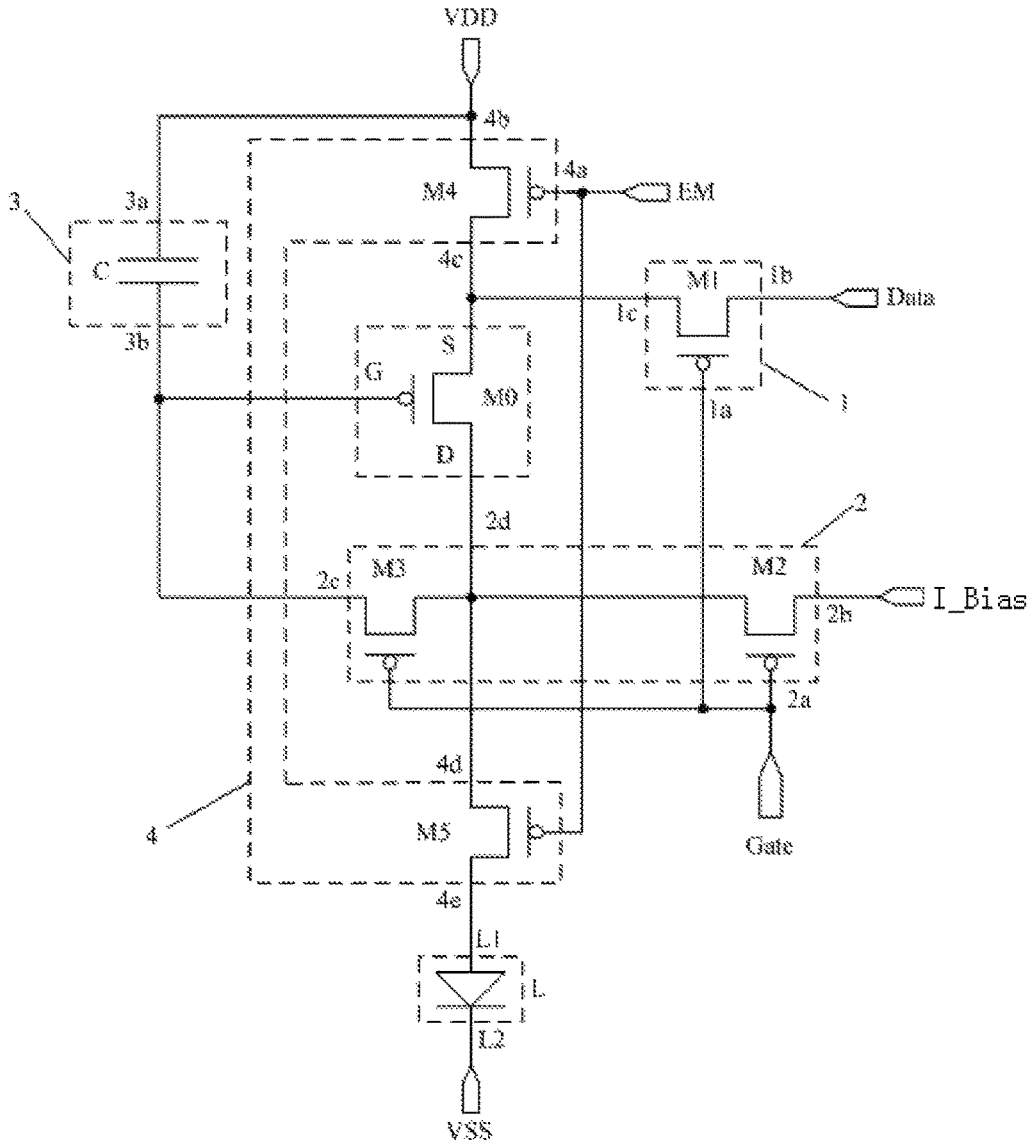
FIG. 2*a* is a schematic view of a possible specific structure of the pixel circuit as shown in FIG. 1*a;*
Figure 2B:
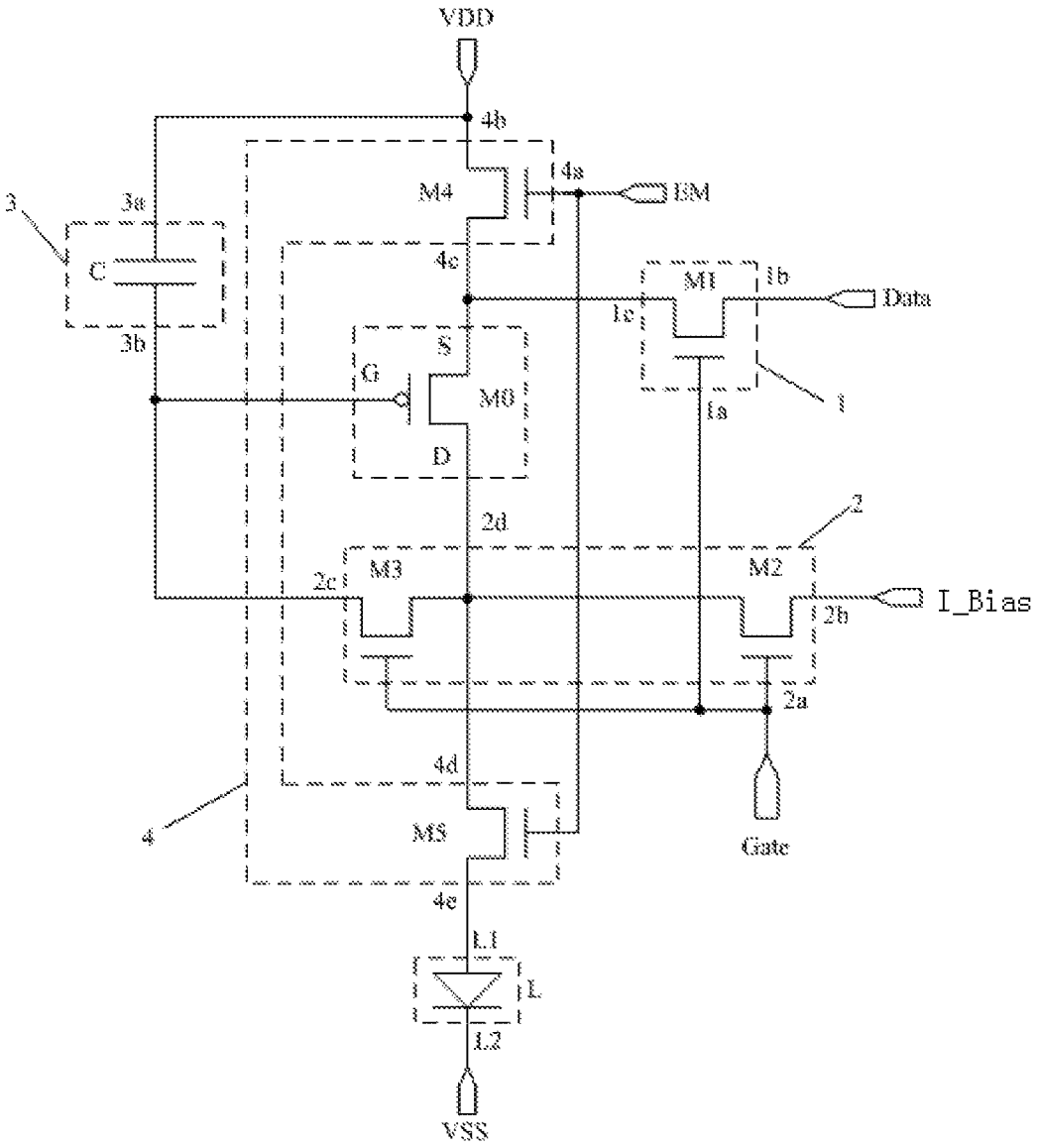
FIG. 2*b* is a schematic view of another possible specific structure of the pixel circuit as shown in FIG. 1*a;*
Figure 3A:
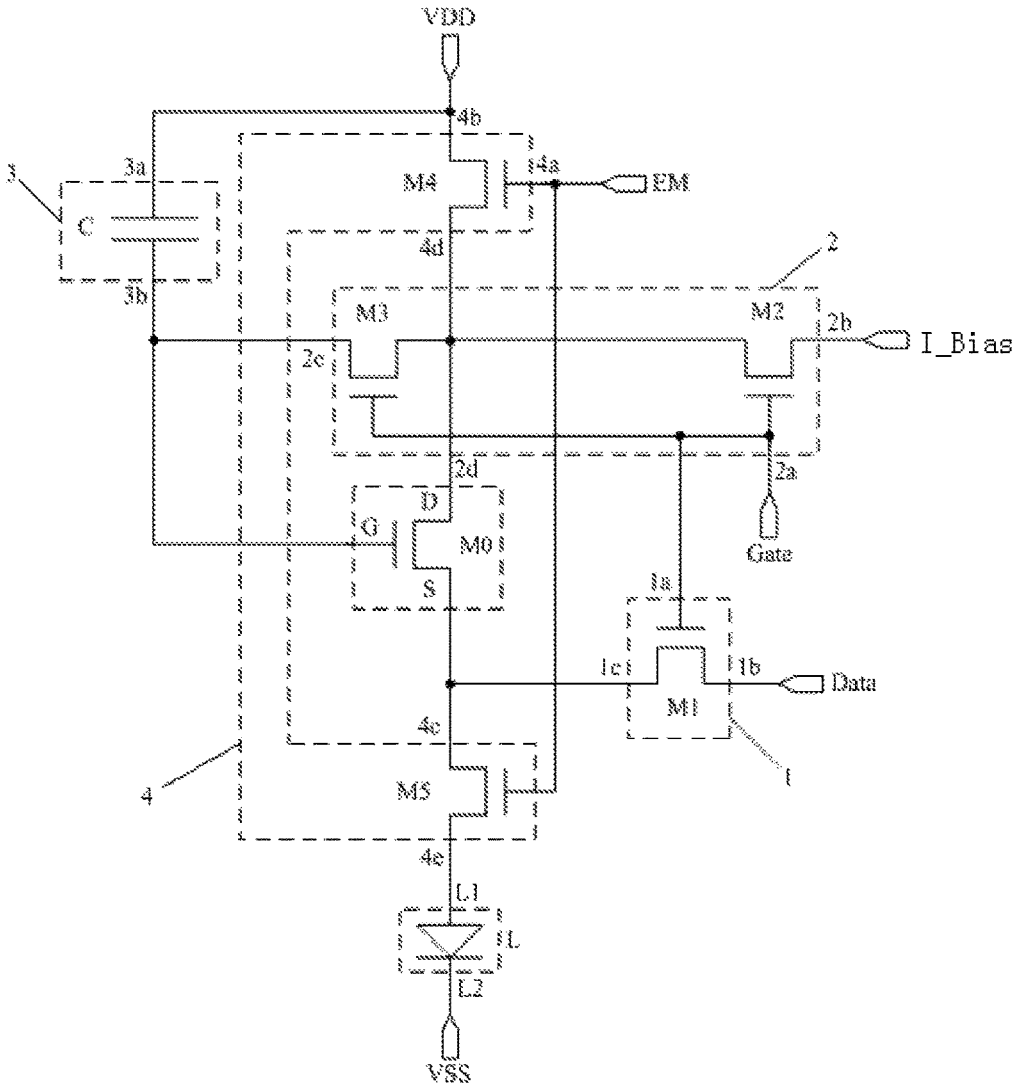
FIG. 3*a* is a schematic view of a possible specific structure of the pixel circuit as shown in FIG. 1*b;*

In the pixel circuit provided by some embodiment of the invention, as shown in FIG. 2*a* and FIG. 2*b*, the driving transistor M0 that drives the light emitting device L to emit light may be a P-type transistor. Alternatively, as shown in FIG. 3*a* and FIG. 3*b*, the driving transistor M0 that drives the light emitting device L to emit light may be an N-type transistor, which will not be defined herein.

In the pixel circuits provided by some embodiments of the invention, as shown in FIG. 2*a* to FIG. 3*b*, the data write module 1 may comprise a first switch transistor M1. A gate of the first switch transistor M1 is connected with the scanning signal Gate, a source thereof may be connected with the data signal Data, and a drain thereof may be connected with the source S of the driving transistor M0.

Figure 3B:
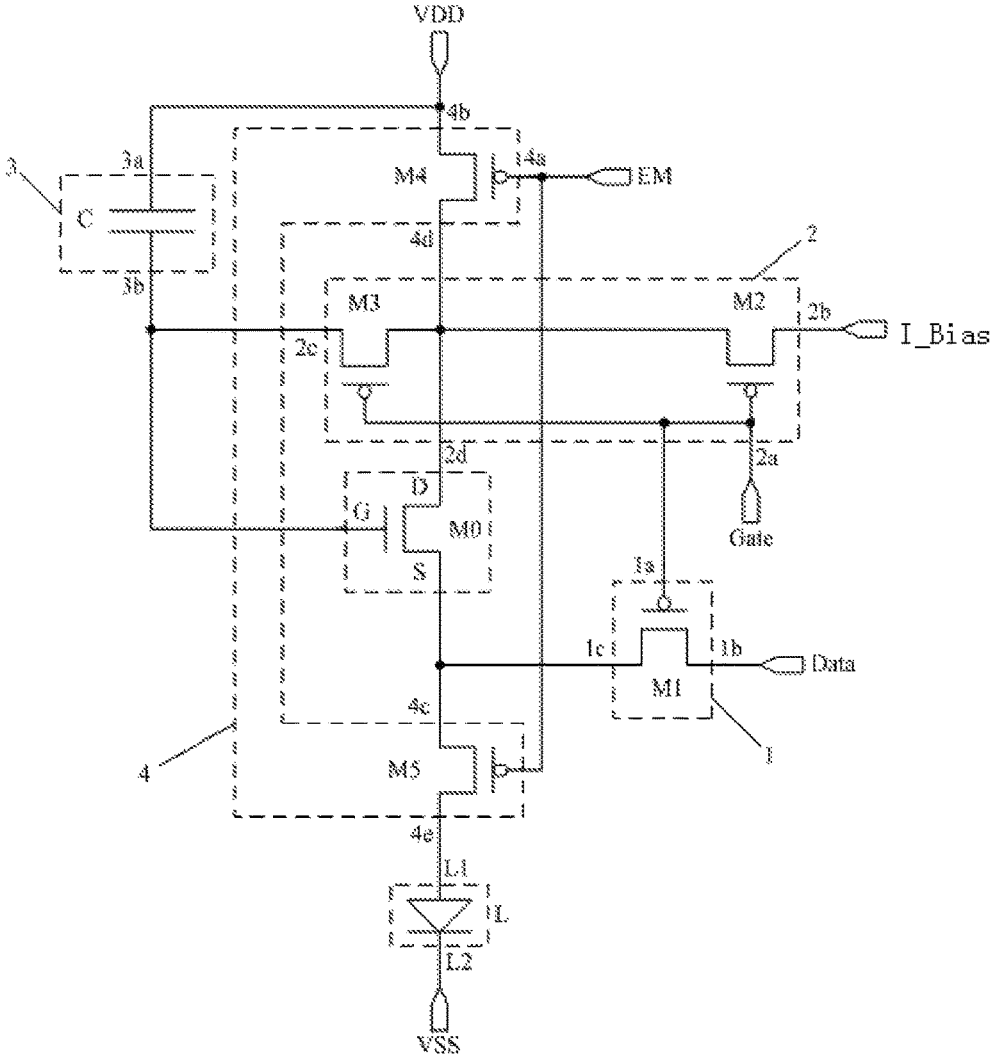
FIG. 3*b* is a schematic view of another possible specific structure of the pixel circuit as shown in FIG. 1*b;*

In the pixel circuits provided by some embodiment of the invention, when the effective pulse signal of the scanning signal Gate is of low level, as shown in FIG. 2*a* and FIG. 3*b*, the first switch transistor M1 may be a P-type switch transistor. Alternatively, when the effective pulse signal of the scanning signal Gate is of high level, as shown in FIG. 2*b* and FIG. 3*a*, the first switch transistor M1 may also be an N-type switch transistor, which will not be defined herein.

For the pixel circuit provided by the embodiment of the invention, when the first switch transistor M1 is in a turn-on state under the control of the scanning signal Gate, the data signal Data is provided to the source of the driving transistor M0.

The above are just illustrations of the specific structure of the data write module 1 in the pixel circuit provided by the embodiment of the invention. In specific implementation, the specific structure of the data write module is not limited to the structure provided by the above example, it can also be other structures known by the skilled person in the art, which will not be defined herein.

In the pixel circuits provided by some embodiments of the invention, as shown in FIG. 2*a* to FIG. 3*b*, the compensation control module 2 may comprise a second switch transistor M2 and a third switch transistor M3. A gate of the second switch transistor M2 is connected with the scanning signal Gate, a source thereof may receive a preset bias current I_Bias, and a drain thereof can be connected with the drain D of the driving transistor M0 and the source of the third switch transistor M3 respectively. A gate of the third switch transistor M3 is connected with the scanning signal Gate, a drain thereof may be connected with the gate G of the driving transistor M0.

For the pixel circuits provided by some embodiments of the invention, when the effective pulse signal of the scanning signal Gate is of low level, as shown in FIG. 2*a* and FIG. 3*b*, the second switch transistor M2 and the third switch transistor M3 may be P-type switch transistors. Alternatively, when the effective pulse signal of the scanning signal Gate is of high level, as shown in FIG. 2*b* and FIG. 3*a*, the second switch transistor M2 and the third switch transistor M3 can also be N-type switch transistors, which will not be defined herein.

For the pixel circuits provided by the above embodiments of the invention, when the second switch transistor M2 is in a turn-on state under the control of the scanning signal, the preset bias current I_Bias is provided to the source of the third switch transistor M3. When the third switch transistor M3 is turned on under the control of the scanning signal, the signal of the source of the third switch transistor M3 is provided to the gate of the driving transistor M0, and the source of the third switch transistor M3 is connected with the drain of the driving transistor M0, the driving transistor M0 is controlled to be in a saturation state, so as to enable the current flowing through the driving transistor M0 to be the preset bias current I_Bias. According to current characteristics in the saturation state, it can be known that the current flowing through the driving transistor meets the equation below: $I_Bias=K(V_{GS}-V_{th})^2=K(V_G-V_{Data}-V_{th})^2$, and $V_G$ is the gate voltage of the driving transistor, $V_{Data}$ is the source voltage of the driving transistor, $V_{th}$ is the threshold voltage of the driving transistor. Moreover, $$K = \frac{1}{2}Cu\frac{W}{L},$$

and C is the channel capacitance of the driving transistor, u is the channel mobility of the driving transistor, W is the channel width of the driving transistor, and L is the channel length of the driving transistor. For driving transistors of the same structure, the values of C, u, W and L are relatively stable, hence, K is relatively stable, and can be regarded as a constant. From the above equations, it can be derived that the gate voltage of the driving transistor $$V_G = \sqrt{\frac{I_Bias}{K}} + V_{Data} + V_{th},$$

thereby storing all of the voltage $V_{Data}$ of the data signal, the threshold voltage $V_{th}$ of the driving transistor and the preset bias current I_Bias in the gate voltage of the driving transistor.

The above are just illustrations of the specific structure of the compensation control module in the pixel circuit provided by the embodiment of the invention. In specific implementation, the specific structure of the compensation control module is not limited to the structure provided by the above examples, it can also be other structures known by the skilled person in the art, which will not be defined herein.

In the pixel circuits provided by the embodiments of the present invention, as shown in FIG. 2*a* to FIG. 3*b*, the storage module 3 can comprises a capacitor C. A first terminal 3*a* of the capacitor C is connected with the first reference signal VDD, and a second terminal 3*b* is connected with the gate G of the driving transistor M0.

In the pixel circuit provided by the embodiment of the invention, the capacitor is charged under the control of the first reference signal VDD and the gate of the driving transistor, so as to keep the voltage of the gate of the driving transistor in a stable state.

The above are only illustrations of the specific structure of the storage module in the pixel circuit provided by the embodiment of the invention. In specific implementation, the specific structure of the storage module is not limited to the structure provided by the above example, it can also be other structures known by the skilled person in the art, which will not be defined herein.

For different types of the driving transistors, the specific connections of the source and the drain of the driving transistor with the light emitting control module may also be different. In the pixel circuits provided by some embodiments of the invention, as shown in FIG. 2*a* and FIG. 2*b*, the driving transistor M0 may be a P-type transistor. The light emitting control module 4 may comprises a fourth switch transistor M4 and a fifth switch transistor M5. A gate of the fourth switch transistor M4 is connected with a light emitting control signal EM, a source is connected with the first reference signal VDD, and a drain is connected with the source S of the driving transistor M0. A gate of the fifth switch transistor M5 is connected with the light emitting control signal EM, a source is connected with the drain D of the driving transistor M0, and a drain is connected with a first terminal L1 of a light emitting device L.

In the pixel circuits provided by the embodiments of the invention, when the fourth switch transistor is in a turn-on state under the control of the light emitting control signal EM, it communicates the first reference signal VDD with the source of the driving transistor M0, so as to provide the first reference signal VDD to the source of the driving transistor M0. When the fifth switch transistor M5 is in a turn-on state under the control of the light emitting control signal EM, it communicates the drain of the driving transistor with the first terminal of the light emitting device, so as to output to the light emitting device the working current that drives the light emitting device to emit light. The working current flows from the source of the driving transistor to its drain. At this time, the driving transistor may be controlled in a saturation state. According to current characteristics of the saturation state, it can be known that the working current $I_L$ that drives the light emitting device to emit light meets the equation of $I_L=K(V_{GS}-V_{th})^2$, and $$\begin{aligned} V_{GS} &= V_G - V_S \\ &= V_G - V_{dd} \\ &= \sqrt{\frac{I_Bias}{K}} + V_{Data} + V_{th} - V_{dd}. \end{aligned}$$

$V_G$ is the gate voltage of the driving transistor, $V_{dd}$ is the voltage of the first reference signal VDD and is the source voltage of the driving transistor. From the above two equations, it can be derived the working current $$I_L = K\left(\sqrt{\frac{I_Bias}{K}} + V_{Data} - V_{dd}\right)^2.$$

Therefore, the working current $I_L$ that drives the light emitting device to emit light is only related to the voltage $V_{Data}$ of the data signal Data, the voltage $V_{dd}$ of the first reference signal VDD and the preset bias current I_Bias, while being unrelated to the threshold voltage $V_{th}$ of the driving transistor, which overcomes the problem of influence on the working current that drives the light emitting device by the drift of the threshold voltage $V_{th}$ caused by the manufacture process of the driving transistor and long time operation, thereby enabling the working current of the light emitting device to remain stable, and in turn ensuring normal operation of the light emitting device.

In the pixel circuits provided by other embodiments of the invention, as shown in FIG. 3*a* and FIG. 3*b*, the driving transistor M0 may be an N-type transistor. The light emitting control module 4 may comprise a fourth switch transistor M4 and a fifth switch transistor M5. The gate of the fourth switch transistor M4 is connected with the light emitting control signal EM, the source can be connected with the first reference signal VDD, and the drain can be connected with the drain D of the driving transistor M0. The gate of the fifth switch transistor M5 is connected with the light emitting control signal EM, the source may be connected with the source S of the driving transistor M0, and the drain may be connected with the first terminal L1 of the light emitting device L.

For the pixel circuits provided by the embodiments of the invention, when the fourth switch transistor is in a turn-on state under the control of the light emitting control signal EM, it communicates the first reference signal with the drain of the driving transistor, so as to provide the first reference signal to the drain of the driving transistor. When the fifth switch transistor is in a turn-on state under the control of the light emitting control signal EM, it communicates the source of the driving transistor with the first terminal of the light emitting device, so as to output to the light emitting device a working current that drives the light emitting device to emit light. The working current flows from the drain of the driving transistor to its source. In this case, the driving transistor can be controlled in a saturation state. According to current characteristics of the saturation state, it can be known that the working current $I_L$ that drives the light emitting device to emit light meets the following equation: $I_L=K(V_{GS}-V_{th})^2$, and $$\begin{aligned} V_{GS} &= V_G - V_S \\ &= V_G - (V_{ss} + V_L) \\ &= \sqrt{\frac{\text{I_Bias}}{K}} + V_{Data} + V_{th} - V_{ss} - V_L. \end{aligned}$$

$V_{ss}$ is the voltage of the second reference signal VSS, $V_L$ is the voltage across the light emitting device, and the sum of $V_{ss}$ and $V_L$ is the source voltage of the driving transistor. From the above two equations, it can be derived the working current $$I_L = K\left(\sqrt{\frac{\text{I_Bias}}{K}} + V_{Data} - V_{ss} - V_L\right)^2.$$

Therefore, the working current $I_L$ that drives the light emitting device to emit light is only related to the voltage $V_{Data}$ of the data signal Data, the voltage $V_{ss}$ of the second reference signal VSS, the voltage $V_L$ of the light emitting device and the preset bias current I_Bias, while being unrelated to the threshold voltage $V_{th}$ of the driving transistor, which overcomes the problem of influence on the working current that drives the light emitting device by drift of the threshold voltage $V_{th}$ caused by the manufacture process of the driving transistor and long time operation, thereby enabling the working current of the light emitting device to remain stable, and ensuring normal operation of the light emitting device.

In the pixel circuits provided by the embodiments of the invention, when the effective pulse signal of the light emitting control signal EM is of low level, as shown in FIG. 2*a* and FIG. 3*b*, the fourth switch transistor M4 and the fifth switch transistor M5 may be P-type switch transistors. Alternatively, when the effective pulse signal of the light emitting control signal EM is of high level, as shown in FIG. 2*b* and FIG. 3*a*, the fourth switch transistor M4 and the fifth switch transistor M5 may also be N-type switch transistors, which will not be defined herein.

The above are only illustrations of the specific structure of the light emitting control module in the pixel circuits provided by the embodiments of the invention. In specific implementation, the specific structure of the light emitting control module is not limited to the structure provided by the above examples, it can also be other structures known by the skilled person in the art, which will not be defined here.

In order to simplify the preparation process, in the pixel circuits provided by some embodiments of the invention, as shown in FIG. 2*a*, when the driving transistor is a P-type transistor, all the switch transistors are P-type switch transistors; or, as shown in FIG. 3*a*, when the driving transistor is an N-type transistor, all the switch transistors are N-type switch transistors. The P-type switch transistors are cut off under the effect of a high level and are turned on under the effect of a low level. The N-type switch transistors are turned on under the effect of a high level and are cut off under the effect of a low level.

In the pixel circuits provided by the above embodiments of the invention, the driving transistor and the switch transistors can be either thin film transistors (TFT), or metal oxide semiconductor (MOS) field effect transistors, which will not be limited herein. In specific implementation, the source and the drain of these transistors may be interchanged, which are not differentiated specifically. For the embodiments described herein, explanations are made by taking the example that the driving transistor and the switch transistors are all thin film transistors.

Next, by taking the pixel circuit as shown in FIG. 2*a* and FIG. 3*a* as example, the working process of the pixel circuits provided by the embodiments of the invention will be described with reference to the timing diagram. In the following description, "1" represents a high level, "0" represents a low level, moreover, "1" and "0" are logical levels, they are only for explaining the specific working process of the pixel circuits of the embodiments of the invention, rather than voltage levels applied on the gates of the switch transistors in specific implementation.

As shown in FIG. 2*a*, the driving transistor M0 is a P-type transistor, and all the switch transistors are P-type switch transistors. The corresponding timing diagram is as shown in FIG. 4*a*, which may comprise a compensation phase T1 and a light emitting phase T2.

Figure 4A:
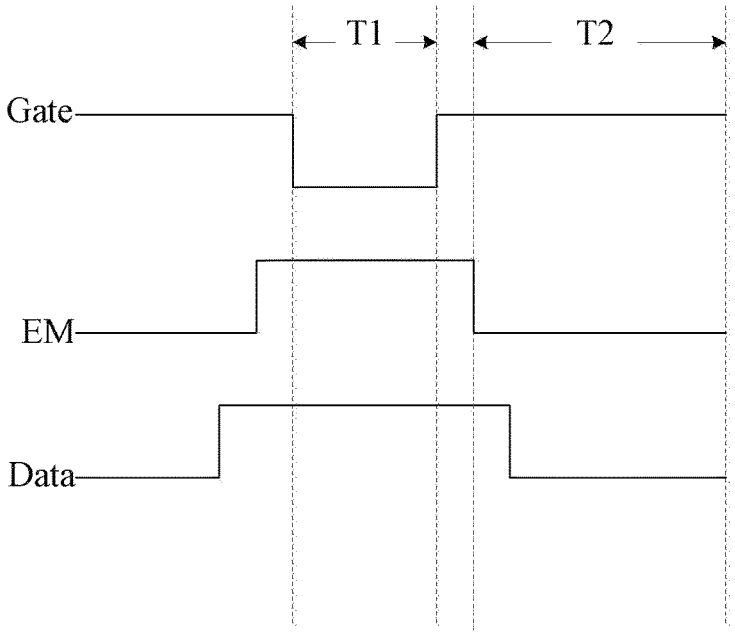
FIG. 4*a* is a timing diagram for a pixel circuit provided by the embodiment of FIG. 2*a;*

As shown in FIG. 4*a*, in the compensation phase T1, Gate=0, EM=1, Data=1.

Since Gate=0, the first switch transistor M1, the second switch transistor M2 and the third switch transistor M3 are all turned on. Since EM=1, the fourth switch transistor M4 and the fifth switch transistor M5 are both cut off. The first switch transistor M1 that has been turned on provides the voltage $V_{Data}$ of the data signal Data to the source S of the driving transistor M0. The second switch transistor M2 that has been turned on provides the preset bias current I_Bias to the drain D of the driving transistor M0 and the source of the third switch transistor M3. Since the third switch transistor M3 is turned on, the signal of the drain D of the driving transistor M0 is written to the gate G of the driving transistor M0, the driving transistor M0 may be controlled to be in a saturation state, thereby enabling the current flowing through the driving transistor M0 to be the preset bias current I_Bias. According to the current characteristics of the driving transistor M0 in a saturation state, it can be known that, the current flowing through the driving transistor M0 meets the following equation:

$I_Bias=K(V_{GS}-V_{th})^2=K(V_G-V_S-V_{th})^2=K(V_G-V_{Data}-V_{th})^2$, $V_G$ is the gate voltage of the driving transistor M0, $V_S$ is the source voltage of the driving transistor M0, $V_{th}$ is the threshold voltage of the driving transistor M0, moreover, $$K = \frac{1}{2}Cu\frac{W}{L},$$

C is the channel capacitance of the driving transistor M0, u is the channel mobility of the driving transistor M0, W is the width of the driving transistor M0, L is the length of the driving transistor M0. For driving transistors of the same structure, the values of C, u, W and L are relatively stable, hence, the value of K is relatively stable and can be regarded as a constant. From the above equations, it can be derived the gate voltage of the driving transistor M0

$$V_G = \sqrt{\frac{I_Bias}{K}} + V_{Data} + V_{th},$$

thereby storing all of the voltage $V_{Data}$ of the data signal Data, the threshold voltage $V_{th}$ of the driving transistor M0 and the preset bias current I_Bias in the gate voltage $V_G$ of the driving transistor M0. Since the capacitor C is charged under control of the first reference signal VDD and the gate G of the driving transistor M0, the gate voltage $V_G$ of the driving transistor M0 can be kept in a stable state.

As shown in FIG. 4*a*, at the starting time period of the light emitting phase T2, Gate=1, EM=0, Data=1.

Since EM=0, the fourth switch transistor M4 and the fifth switch transistor M5 are both turned on. Since Gate=1, the first switch transistor M1, the second switch transistor M2 and the third switch transistor M3 are all cut off. The fourth switch transistor M4 that has been turned on provides the voltage $V_{dd}$ of the first reference signal VDD to the source S of the driving transistor M0, the fifth switch transistor M5 that has been turned on communicates the drain D of the driving transistor M0 with the first terminal L1 of the light emitting device L. The driving transistor M0 is in a saturation state at this time. Since the driving transistor M0 is a P-type transistor and is in a saturation state, from the current characteristics in a saturation state it can be known that the working current $I_L$ that flows through the driving transistor M0 and drives the light emitting device L to emit light meets the equation of $I_L=K(V_G-V_{th})^2$.

$$\begin{aligned} V_{GS} &= V_G - V_S \\ &= V_G - V_{dd} \\ &= \sqrt{\frac{I_Bias}{K}} + V_{Data} + V_{th} - V_{dd}. \end{aligned}$$

$V_G$ is the gate voltage of the driving transistor, $V_{dd}$ is the voltage of the first reference signal VDD and is the source voltage of the driving transistor M0. From the above two equations, it can be obtained the working current $$I_L = K\left(\sqrt{\frac{I_Bias}{K}} + V_{Data} - V_{dd}\right)^2.$$

Therefore, the working current $I_L$ of the driving transistor M0 that drives the light emitting device L to emit light is only related to the voltage $V_{Data}$ of the data signal Data, the voltage $V_{dd}$ of the first reference signal VDD and the preset bias current I_Bias, while being unrelated to the threshold voltage $V_{th}$ of the driving transistor M0, which overcomes the problem of influence on the working current that drives the light emitting device L by drift of the threshold voltage $V_{th}$ caused by the manufacture procedure of the driving transistor M0 and long time operation, thereby enabling the working current of the light emitting device L to remain stable, and ensuring normal operation of the light emitting device L.

Thereafter, Gate=1, EM=0, Data=0. Since Gate=1, the first switch transistor M1, the second switch transistor M2 and the third switch transistor M3 are all cut off. Hence, the voltage $V_{Data}$ of the data signal Data has no influence on the working current $I_L$ of the pixel circuit that drives the light emitting device L to emit light, therefore, the working current $I_L$ that drives the light emitting device L to emit light remains unchanged.

Figure 4B:
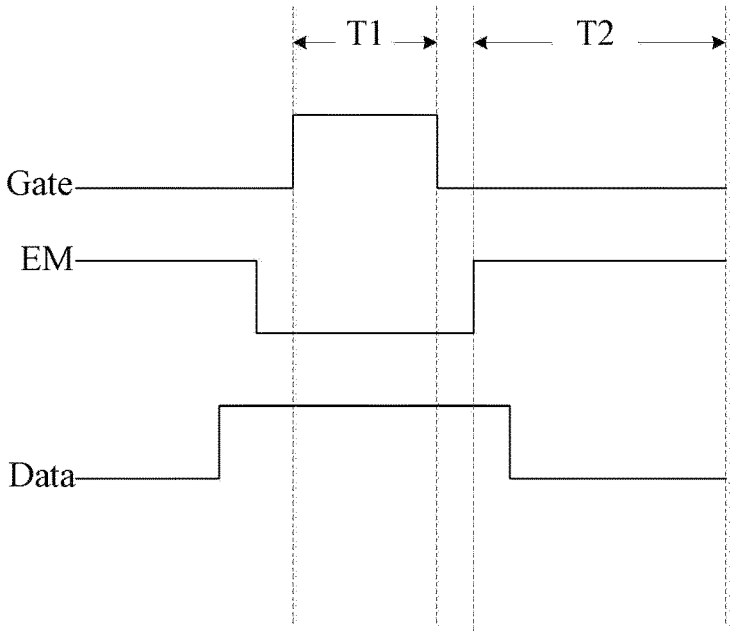
FIG. 4*b* is a timing diagram for a pixel structure provided by the embodiment of FIG. 3*a;*

As shown in FIG. 3, the driving transistor M0 is an N-type transistor, and all the switch transistors are N-type switch transistors. The corresponding timing diagram is as shown in FIG. 4*b*, comprising two phases of a compensation phase T1 and a light emitting phase T2.

In the compensation phase T1, Gate=1, EM=0, Data=1.

Since Gate=1, the first switch transistor M1, the second switch transistor M2 and the third switch transistor M3 are all turned on. Since EM=0, the fourth switch transistor M4 and the fifth switch transistor M5 are both cut off. The first switch transistor M1 that has been turned on provides the voltage $V_{Data}$ of the data signal Data to the source S of the driving transistor M0. The second switch transistor M2 that has been turned on provides the preset bias current I_Bias to the source of the third switch transistor M3 and the drain of the driving transistor M0. Since the third switch transistor M3 is turned on, the signal of the drain of the driving transistor M0 is provided to the gate G of the driving transistor M0, such that the driving transistor M0 can be controlled to be in a saturation state, enabling the current flowing through the driving transistor M0 to be the preset bias current I_Bias. The skilled person in the art can understand that for the embodiment as shown in FIG. 3*a*, the preset bias current provided to the second switch transistor M2 may differ from the preset bias current in the embodiment as shown in FIG. 2*a*. According to the current characteristics of the driving transistor M0 in a saturation state, it can be determined that the current flowing through the driving transistor M0 meets the equation of $I_Bias=K(V_{GS}-V_{th})^2=K(V_G-V_S-V_{th})^2=K(V_G-V_{Data}-V_{th})^2$, $V_G$ is the gate voltage of the driving transistor M0, $V_S$ is the source voltage of the driving transistor M0, $V_{th}$ is the threshold voltage of the driving transistor M0, moreover, $$K = \frac{1}{2}Cu\frac{W}{L},$$

C is the channel capacitance of the driving transistor M0, u is the channel mobility of the driving transistor M0, W is the width of the driving transistor M0, and L is the length of the driving transistor M0. For driving transistors of the same structure, the values of C, u, W and L are relatively stable, hence, the value of K is relatively stable and can be regarded as a constant. From the above equation it can be obtained the gate voltage of the driving transistor M0

$$V_G = \sqrt{\frac{\text{I_Bias}}{K}} + V_{Data} + V_{th},$$

thereby storing all of the voltage $V_{Data}$ of the data signal Data, the threshold voltage $V_{th}$ of the driving transistor M0 and the preset bias current I_Bias in the gate voltage $V_G$ of the driving transistor M0. Since the capacitor C is charged under control of the first reference signal VDD and the gate G of the driving transistor M0, the gate voltage of the driving transistor M0 can be kept in a stable state.

As shown in FIG. 4*b*, at the starting time period of the light emitting phase T2, Gate=0, EM=1, Data=1.

Since EM=1, the fourth switch transistor M4 and the fifth switch transistor M5 are both turned on. Since Gate=0, the first switch transistor M1, the second switch transistor M2 and the third switch transistor M3 are all cut off. The fourth switch transistor M4 that has been turned on provides the voltage $V_{dd}$ of the first reference signal VDD to the drain D of the driving transistor M0, the fifth switch transistor M5 that has been turned on communicates the source S of the driving transistor M0 with the first terminal L1 of the light emitting device L, and the driving transistor M0 is controlled to be in a saturation state at this time. Since the driving transistor M0 is an N-type transistor and is in a saturation state, according to the current characteristics of the saturation state, it can be determined that the working current $I_L$ that flows through the driving transistor M0 and is used for driving the light emitting device L to emit light meets the equation of $I_L=K(V_{GS}-V_{th})^2$, and $$\begin{aligned} V_{GS} &= V_G - V_S \\ &= V_G - (V_{ss} + V_L) \\ &= \sqrt{\frac{\text{I_Bias}}{K}} + V_{Data} + V_{th} - V_{ss} - V_L, \end{aligned}$$

$V_{ss}$ is the voltage of the second reference signal VSS, $V_L$ is the voltage across the light emitting device, and the sum of $V_{ss}$ and $V_L$ is the source voltage of the driving transistor M0. From the above two equations, it can be derived the working current $$I_L = K\left(\sqrt{\frac{\text{I_Bias}}{K}} + V_{Data} - V_{ss} - V_L\right)^2.$$

Therefore, the working current $I_L$ of the driving transistor M0 that drives the light emitting device L to emit light is only related to the voltage $V_{Data}$ of the data signal Data, the voltage $V_{ss}$ of the second reference signal VSS, the voltage $V_L$ of the light emitting device L and the preset bias current I_Bias, while being unrelated to the threshold voltage $V_{th}$ of the driving transistor M0, which overcomes the problem of influence on the working current that drives the light emitting device L by drift of the threshold voltage $V_{th}$ caused by the manufacture procedure of the driving transistor M0 and long time operation, thereby enabling the working current of the light emitting device L to remain stable, and ensuring normal operation of the light emitting device L.

Thereafter, Gate=0, EM=1, Data=0. Since Gate=0, the first switch transistor M1, the second switch transistor M2 and the third switch transistor M3 are all cut off. Hence, the voltage $V_{Data}$ of the data signal Data has no influence on the working current $I_L$ of the pixel circuit that drives the light emitting device L to emit light, therefore, the working current $I_L$ that drives the light emitting device L to emit light remains unchanged.

Figure 5:
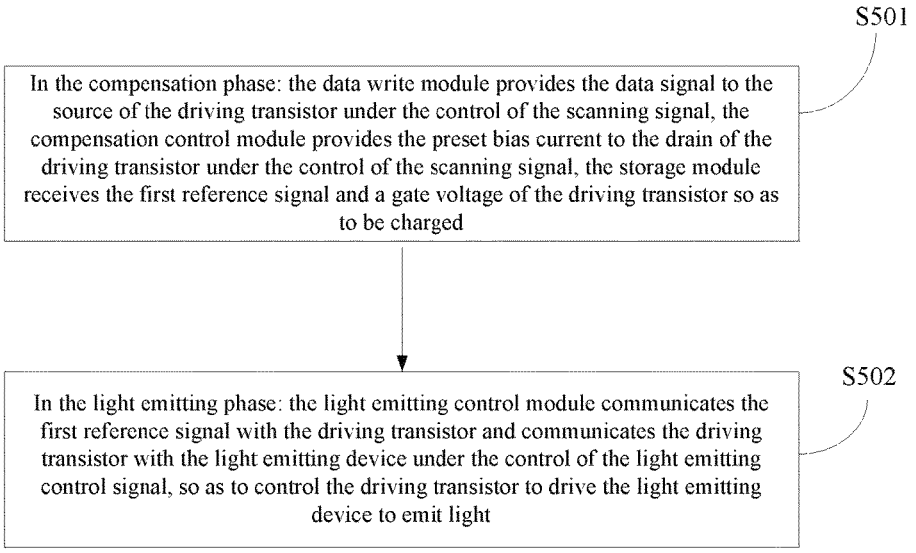
FIG. 5 is a flow chart of a method for driving a pixel circuit provided by an embodiment of the present invention.

Based on the same inventive concept, a further embodiment of the invention provides a method for driving a pixel circuit provided by any of the above embodiments. As shown in FIG. 5, the method may comprise a compensation phase and a light emitting phase.

S501: in the compensation phase, the data write module provides the data signal to the source of the driving transistor under the control of the scanning signal, the compensation control module provides the preset bias current to the drain of the driving transistor under the control of the scanning signal, and control the driving transistor to be in a saturation state, so as to enable a current flowing through the driving transistor to be the preset bias current, the storage module receives the first reference signal and a gate voltage of the driving transistor so as to be charged.

S502: in the light emitting phase, the light emitting control module communicates the first reference signal with the driving transistor and communicates the driving transistor with the light emitting device under the control of the light emitting control signal, so as to control the driving transistor to drive the light emitting device to emit light.

For the above driving method provided by the embodiment of the invention, in the compensation phase, by means of the cooperation of the data write module, the compensation control module and the storage module, the driving transistor is controlled to be in a saturation state to enable the current flowing through the driving transistor to be the preset bias current, therefore, the voltage of the data signal, the threshold voltage of the driving transistor and the preset bias current can all be stored in the gate voltage of the driving transistor. In the light emitting phase, the light emitting control module communicates the first reference signal with the driving transistor and communicates the driving transistor with the light emitting device, the driving transistor may be kept in a saturation state. Thus the working current of the driving transistor that drives the light emitting device to emit light may be unrelated to the threshold voltage of the driving transistor, which can avoid drift of the threshold voltage from influencing the light emitting device, thereby enabling the working current that drives the light emitting device to emit light to remain stable, so as to improve brightness uniformity of the displayed image.

Based on the same inventive concept, a further embodiment of the invention provides an organic electroluminescent display panel. The organic electroluminescent display panel can comprise a pixel circuit provided by any of the above embodiments of the invention. The organic electroluminescent display panel may be any product or component with the display function such as a mobile phone, a panel computer, a television, a display, a laptop, a digital photo frame, a navigator, etc. Other essential components of the organic electroluminescent display panel should be understood by the ordinary skilled person in the art, which will not be repeated herein and should not be taken as limitations to the invention, either. The implementation of the organic electroluminescent display panel can make reference to the above embodiments of the pixel circuit, which will not be repeated herein.

Embodiments of the invention provide the pixel circuit, the driving method thereof and the organic electroluminescent display panel. The pixel circuit comprises a driving transistor, a data write module, a compensation control module, a storage module and a light emitting control module. The data write module is used for providing the data signal to the source of the driving transistor under the control of the scanning signal. The compensation control module is used to provide the preset bias current to the drain of the driving transistor under the control of the scanning signal and control the driving transistor to be in a saturation state, so as to enable a current flowing through the driving transistor to be the preset bias current. The storage module is used for receiving the first reference signal and a gate voltage of the driving transistor so as to be charged. The light emitting control module is used for communicating the first reference signal with the driving transistor and communicating the driving transistor with the light emitting device under the control of the light emitting control signal, so as to control the driving transistor to drive the light emitting device to emit light. The voltage of the first reference signal is greater than the voltage of the second reference signal. For the pixel circuits provided by the embodiments of the invention, by means of cooperation of the above four modules, the working current of the driving transistor that drives the light emitting device to emit light can be unrelated to the threshold voltage of the driving transistor, which may avoid drift of the threshold voltage from influencing the light emitting device, thereby enabling the working current that drives the light emitting device to emit light to remain stable, so as to improve brightness uniformity of the displayed image.

Apparently, the skilled person in the art can make various modifications and variations to the embodiments of the invention without departing from the spirit and the scope of the invention. In this way, provided that these modifications and variations belong to the scopes of the claims of the invention and the equivalent technologies thereof, the present invention also intends to encompass these modifications and variations.

The invention claimed is:

1. A pixel circuit, comprising:

a driving transistor;

a data write module, a first terminal of the data write module being connected with a scanning signal, a second terminal of the data write module being connected with a data signal, a third terminal of the data write module being connected with a source of the driving transistor, the data write module being used for providing the data signal to the source of the driving transistor under control of the scanning signal;

a compensation control module, a first terminal of the compensation control module being connected with the scanning signal, a second terminal of the compensation control module being used for receiving a preset bias current, a third terminal of the compensation control module being connected with a gate of the driving transistor, a fourth terminal of the compensation control module being connected with a drain of the driving transistor;

a storage module, a first terminal of the storage module being connected with a first reference signal, a second terminal of the storage module being connected with the gate of the driving transistor, the storage module being used for receiving the first reference signal and a gate voltage of the driving transistor so as to be charged;

a light emitting control module, a first terminal of the light emitting control module being connected with a light emitting control signal, a second terminal of the light emitting control module being connected with the first reference signal, a third terminal of the light emitting control module being connected with the source of the driving transistor, a fourth terminal of the light emitting control module being connected with the drain of the driving transistor, a fifth terminal of the light emitting control module being connected with a first terminal of a light emitting device, a second terminal of the light emitting device being connected with a second reference signal, the light emitting control module being used for communicating the first reference signal with the driving transistor, and communicating the driving transistor with the light emitting device under control of the light emitting control signal, so as to control the driving transistor to drive the light emitting device to emit light, wherein a voltage of the first reference signal is greater than a voltage of the second reference signal, wherein the compensation control module comprises a second switch transistor and a third switch transistor, wherein a gate of the second switch transistor is connected with the scanning signal, a source of the second switch transistor is used for receiving the preset bias current, a drain of the second switch transistor is directly connected with the drain of the driving transistor and a source of the third switch transistor respectively, wherein a gate of the third switch transistor is connected with the scanning signal, a drain of the third switch transistor is connected with the gate of the driving transistor, wherein the data write module comprises a first switch transistor, a gate of the first switch transistor being connected with the scanning signal, a source of the first switch transistor being connected with the data signal, and a drain of the first switch transistor being connected with the source of the driving transistor, wherein the first switch transistor, the second switch transistor and the third switch transistor are configured to be turned on under control of the scanning signal before the light emitting device begins to emit light, such that a gate voltage of the driving transistor is equal to an expression as follows:

$$V_G = \sqrt{\frac{\text{I_Bias}}{K}} + V_{Data} + V_{th},$$

wherein $V_G$ represents the gate voltage of the driving transistor, K is a constant, I_Bias is the preset bias current, $V_{Data}$ is a voltage of the data signal, $V_{th}$ represents a threshold voltage of the driving transistor.

2. The pixel circuit as claimed in claim 1, wherein the storage module comprises a capacitor, wherein a first terminal of the capacitor is connected with the first reference signal, a second terminal of the capacitor is connected with the gate of the driving transistor.

3. The pixel circuit as claimed in claim 1, wherein the driving transistor comprises a P-type transistor.

4. The pixel circuit as claimed in claim 3, wherein the light emitting control module comprises a fourth switch transistor and a fifth switch transistor, wherein a gate of the fourth switch transistor is connected with the light emitting control signal, a source of the fourth switch transistor is connected with the first reference signal, a drain of the fourth switch transistor is connected with the source of the driving transistor, wherein a gate of the fifth switch transistor is connected with the light emitting control signal, a source of the fifth switch transistor is connected with the drain of the driving transistor, a drain of the fifth switch transistor is connected with the first terminal of the light emitting device.

5. The pixel circuit as claimed in claim 4, wherein all the switch transistors are P-type switch transistors.

6. The pixel circuit as claimed in claim 1, wherein the driving transistor comprises an N-type transistor.

7. The pixel circuit as claimed in claim 6, wherein the light emitting control module comprises a fourth switch transistor and a fifth switch transistor, wherein a gate of the fourth switch transistor is connected with the light emitting control signal, a source of the fourth switch transistor is connected with the first reference signal, a drain of the fourth switch transistor is connected with the drain of the driving transistor, wherein a gate of the fifth switch transistor is connected with the light emitting control signal, a source of the fifth switch transistor is connected with the source of the driving transistor, a drain of the fifth switch transistor is connected with the first terminal of the light emitting device.

8. The pixel circuit as claimed in claim 7, wherein all the switch transistor are N-type switch transistors.

9. An organic electroluminescent display panel, comprising a pixel circuit, the pixel circuit comprising:

a driving transistor;

a data write module, a first terminal of the data write module being connected with a scanning signal, a second terminal of the data write module being connected with a data signal, a third terminal of the data write module being connected with a source of the driving transistor, the data write module being used for providing the data signal to the source of the driving transistor under control of the scanning signal;

a compensation control module, a first terminal of the compensation control module being connected with the scanning signal, a second terminal of the compensation control module being used for receiving a preset bias current, a third terminal of the compensation control module being connected with a gate of the driving transistor, a fourth terminal of the compensation control module being connected with a drain of the driving transistor;

a storage module, a first terminal of the storage module being connected with a first reference signal, a second terminal of the storage module being connected with the gate of the driving transistor, the storage module being used for receiving the first reference signal and a gate voltage of the driving transistor so as to be charged;

a light emitting control module, a first terminal of the light emitting control module being connected with a light emitting control signal, a second terminal of the light emitting control module being connected with the first reference signal, a third terminal of the light emitting control module being connected with the source of the driving transistor, a fourth terminal of the light emitting control module being connected with the drain of the driving transistor, a fifth terminal of the light emitting control module being connected with a first terminal of a light emitting device, a second terminal of the light emitting device being connected with a second reference signal, the light emitting control module being used for communicating the first reference signal with the driving transistor, and communicating the driving transistor with the light emitting device under control of the light emitting control signal, so as to control the driving transistor to drive the light emitting device to emit light, wherein a voltage of the first reference signal is greater than a voltage of the second reference signal, wherein the compensation control module comprises a second switch transistor and a third switch transistor, wherein a gate of the second switch transistor is connected with the scanning signal, a source of the second switch transistor is used for receiving the preset bias current, a drain of the second switch transistor is directly connected with the drain of the driving transistor and a source of the third switch transistor respectively, wherein a gate of the third switch transistor is connected with the scanning signal, a drain of the third switch transistor is connected with the gate of the driving transistor, wherein the data write module comprises a first switch transistor, a gate of the first switch transistor being connected with the scanning signal, a source of the first switch transistor being connected with the data signal, and a drain of the first switch transistor being connected with the source of the driving transistor, wherein the first switch transistor, the second switch transistor and the third switch transistor are configured to be turned on under control of the scanning signal before the light emitting device begins to emit light, such that a gate voltage of the driving transistor is equal to an expression as follows:

$$V_G = \sqrt{\frac{\text{I_Bias}}{K}} + V_{Data} + V_{th},$$

wherein $V_G$ represents the gate voltage of the driving transistor, K is a constant, I_Bias is the preset bias current, $V_{Data}$ is a voltage of the data signal, $V_{th}$ represents a threshold voltage of the driving transistor.

10. The organic electroluminescent display panel as claimed in claim 9, wherein the storage module comprises a capacitor, wherein a first terminal of the capacitor is connected with the first reference signal, a second terminal of the capacitor is connected with the gate of the driving transistor.

11. The organic electroluminescent display panel as claimed in claim 9, wherein the driving transistor comprises a P-type transistor.

12. The organic electroluminescent display panel as claimed in claim 11, wherein the light emitting control module comprises a fourth switch transistor and a fifth switch transistor, wherein a gate of the fourth switch transistor is connected with the light emitting control signal, a source of the fourth switch transistor is connected with the first reference signal, a drain of the fourth switch transistor is connected with the source of the driving transistor, wherein a gate of the fifth switch transistor is connected with the light emitting control signal, a source of the fifth switch transistor is connected with the drain of the driving transistor, a drain of the fifth switch transistor is connected with the first terminal of the light emitting device.

13. The organic electroluminescent display panel as claimed in claim 12, wherein all the switch transistors are P-type switch transistors.

14. The organic electroluminescent display panel as claimed in claim 9, wherein the driving transistor comprises an N-type transistor.

15. The organic electroluminescent display panel as claimed in claim 14, wherein the light emitting control module comprises a fourth switch transistor and a fifth switch transistor, wherein a gate of the fourth switch transistor is connected with the light emitting control signal, a source of the fourth switch transistor is connected with the first reference signal, a drain of the fourth switch transistor is connected with the drain of the driving transistor, wherein a gate of the fifth switch transistor is connected with the light emitting control signal, a source of the fifth switch transistor is connected with the source of the driving transistor, a drain of the fifth switch transistor is connected with the first terminal of the light emitting device.

16. A method for driving a pixel circuit, the pixel circuit comprising:

a driving transistor;

a data write module, a first terminal of the data write module being connected with a scanning signal, a second terminal of the data write module being connected with a data signal, a third terminal of the data write module being connected with a source of the driving transistor, the data write module being used for providing the data signal to the source of the driving transistor under control of the scanning signal, the data write module comprising a first switch transistor, a gate of the first switch transistor being connected with the scanning signal, a source of the first switch transistor being connected with the data signal, and a drain of the first switch transistor being connected with the source of the driving transistor;

a compensation control module, a first terminal of the compensation control module being connected with the scanning signal, a second terminal of the compensation control module being used for receiving a preset bias current, a third terminal of the compensation control module being connected with a gate of the driving transistor, a fourth terminal of the compensation control module being connected with a drain of the driving transistor;

a storage module, a first terminal of the storage module being connected with a first reference signal, a second terminal of the storage module being connected with the gate of the driving transistor, the storage module being used for receiving the first reference signal and a gate voltage of the driving transistor so as to be charged;

a light emitting control module, a first terminal of the light emitting control module being connected with a light emitting control signal, a second terminal of the light emitting control module being connected with the first reference signal, a third terminal of the light emitting control module being connected with the source of the driving transistor, a fourth terminal of the light emitting control module being connected with the drain of the driving transistor, a fifth terminal of the light emitting control module being connected with a first terminal of a light emitting device, a second terminal of the light emitting device being connected with a second reference signal, the light emitting control module being used for communicating the first reference signal with the driving transistor and communicating the driving transistor with the light emitting device under control of the light emitting control signal, so as to control the driving transistor to drive the light emitting device to emit light, wherein a voltage of the first reference signal is greater than a voltage of the second reference signal, wherein the compensation control module comprises a second switch transistor and a third switch transistor, wherein a gate of the second switch transistor is connected with the scanning signal, a source of the second switch transistor is used for receiving the preset bias current, a drain of the second switch transistor is directly connected with the drain of the driving transistor and a source of the third switch transistor respectively, wherein a gate of the third switch transistor is connected with the scanning signal, a drain of the third switch transistor is connected with the gate of the driving transistor, and wherein the method comprises a compensation phase and a light emitting phase;

wherein, in the compensation phase, the first switch transistor, the second switch transistor and the third switch transistor are configured to be turned on under control of the scanning signal such that a gate voltage of the driving transistor is equal to an expression as follows:

$$V_G = \sqrt{\frac{\text{I_Bias}}{K}} + V_{Data} + V_{th},$$

wherein $V_G$ represents the gate voltage of the driving transistor, K is a constant, I_Bias is the preset bias current, $V_{Data}$ is a voltage of the data signal, $V_{th}$ represents a threshold voltage of the driving transistor;

wherein, in the light emitting phase, the light emitting control module communicates the first reference signal with the driving transistor and communicates the driving transistor with the light emitting device under control of the light emitting control signal, so as to control the driving transistor to drive the light emitting device to emit light.

* * * * *